United States Patent [19]

Kaufman et al.

[11] Patent Number: 4,459,132

[45] Date of Patent: Jul. 10, 1984

[54] FUEL COMPOSITION CONTAINING A WEAR INHIBITOR

[75] Inventors: Benjamin J. Kaufman, Wappingers Falls; Mark D. Levin, Poughkeepsie, both of N.Y.

[73] Assignee: Texaco Inc., White Plains, N.Y.

[21] Appl. No.: 524,792

[22] Filed: Aug. 19, 1983

[51] Int. Cl.[3] ..... C10L 1/22

[52] U.S. Cl. ..... 44/56; 44/66; 44/71

[58] Field of Search ..... 44/56, 66, 71

[56] References Cited

U.S. PATENT DOCUMENTS

| | | | |
|---|---|---|---|
| 2,830,019 | 4/1958 | Fields et al. | 44/71 |
| 2,839,372 | 6/1958 | Lindstrom et al. | 44/71 |
| 2,840,600 | 6/1958 | DuBrow et al. | 44/71 |
| 2,851,344 | 9/1958 | Marsh et al. | 44/71 |
| 2,851,345 | 9/1958 | Marsh et al. | 44/71 |
| 2,901,335 | 8/1959 | Fields et al. | 44/71 |
| 2,996,366 | 8/1961 | Churchill et al. | 44/71 |
| 3,442,630 | 5/1969 | Annable et al. | 44/66 |
| 4,365,972 | 12/1982 | Sung et al. | 44/56 |

*Primary Examiner*—Charles F. Warren
*Assistant Examiner*—Y. Harris-Smith
*Attorney, Agent, or Firm*—Robert A. Kulason; Robert Knox, Jr.; Carl G. Seutter

[57] ABSTRACT

A novel fuel composition contains gasohol plus, as a wear-inhibiting additive, a reaction product of an acrylic acid or methacrylic acid and an amine such as mono-oleyl amine.

25 Claims, No Drawings

FUEL COMPOSITION CONTAINING A WEAR INHIBITOR

FIELD OF THE INVENTION

This invention relates to a fuel composition for internal combustion engines particularly characterized by wear inhibition.

BACKGROUND OF THE INVENTION

As is well known to those skilled in the art, fuel compositions typified by gasohol, which are to be considered for commercial use must possess anti-wear activity; and this may be effected by addition thereto of various inhibition systems.

A wide variety of compounds have been tested for this purpose. Many of these compounds are nitrogen-containing compounds. Interesting nitrogen-containing compounds include those disclosed in U.S. Pat. Nos. 4,326,050 or 4,332,720, or 4,315,079 to Schulze et al; U.S. Pat. No. 2,993,021 to Bavley et al; Paytash et al JACS 72, 1415 (1950), etc.

It is an object of this invention to provide a fuel composition for internal combustion engines particularly characterized by wear inhibition. Other objects will be apparent to those skilled in the art.

STATEMENT OF THE INVENTION

In accordance with certain of its aspects, the fuel composition of this invention may comprise (a) a major portion of a fuel containing (i) at least one alcohol selected from the group consisting of ethanol and methanol and (ii) gasoline; and (b) a minor wear-inhibiting amount of, as a wear-inhibiting additive, a reaction product of the acid containing the group $$R-CH=\overset{\overset{\displaystyle R'''}{|}}{C}-COOH$$

and the amine $(R'NH)_{1-a}H_aR''NH_2$ wherein R,R', and R''' are hydrogen, alkyl, alkenyl, alkaryl, aralkyl, aryl, cycloalkenyl, or cycloalkyl; R'' is alkylene, cycloalkylene, aralkylene, alkarylene, or arylene; and a is 0 or 1.

DESCRIPTION OF THE INVENTION

The fuel for internal combustion engines which may be treated by the process of this invention may contain (i) at least one alcohol selected from the group consisting of ethanol and methanol and (ii) gasoline.

The fuels which may be treated include gasohols which may typically be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous, i.e. that they contain less than about 0.3 v % water; typically they may contain 0.0001 v %–0.05 v %, say about 0.04 v % water.

It is a feature of these fuels that they may undesirably contain acidic contaminants which may cause serious corrosion problems. These contaminants are particularly in evidence when the alcohol from which they are formed is a commercially available alcohol which contains therein inter alia acids concurrently produced as by fermentation processes for producing ethanol or acids which have been picked up during handling. Acetic acid is a common acid present in the commercially available alcohols produced by fermentation; and it may be present in amount of 0.003 w %–0.005 w % of the total of the alcohol.

In accordance with practice of the process of this invention, there may be added to the fuel a minor wear-inhibiting amount of, as a wear-inhibiting additive, a reaction product of an acid containing the group $$R-CH=\overset{\overset{\displaystyle R'''}{|}}{C}-COOH$$

and the amine $(R'NH)_{1-a}H_aR''NH_2$ wherein R,R''', and R' are hydrogen, alkyl, alkenyl, alkaryl, aralkyl, aryl, cycloalkenyl, or cycloalkyl, R'' is an alkylene, cycloalkylene, aralkylene, alkarylene, or arylene hydrocarbon group; R''' is preferably hydrogen or methyl; and a is 0 or 1.

The charge unsaturated carboxylic acids which may be used in practice of the process of this invention are characterized by the presence of the group —C=C—COOH and may typically have the formula $$R-CH=\overset{\overset{\displaystyle R'''}{|}}{C}-COOH$$

wherein R''' is preferably hydrogen or methyl. Valence bonds in this structure, or in others in this specification, may be filled with hydrogen or with inert substituents which do not interfere with the reaction.

In the above compound, R or R''' may be hydrogen or a hydrocarbon radical selected from the group consisting of alkyl, aralkyl, cycloalkyl aryl, alkaryl, and alkenyl including such radicals when inertly substituted. When R, or R''' is alkyl, it may typically be methyl, ethyl, n-propyl, iso-propyl, n-butyl, i-butyl, sec-butyl, amyl, octyl, decyl, octadecyl, etc. When R is aralkyl, it may typically be benzyl, beta-phenylethyl, etc. When R or R''' is cycloalkyl, it may typically be cyclohexyl, cycloheptyl, cyclooctyl, 2-methylcycloheptyl, 3-butylcyclohexyl, 3-methylcyclohexyl, etc. When R or R''' is aryl, it may typically be phenyl, naphthyl, etc. When R or R''' is alkaryl, it may typically be tolyl, xylyl, etc. When R or R''' is alkenyl, it may typically be vinyl, allyl, 1-butenyl, etc. R or R''' may be inertly substituted i.e. it may bear a non-reactive substituent such as alkyl, aryl, cycloalkyl, ether, nitro, etc. Typically inertly substituted R or R''' groups may include 2-ethoxyethyl, carboethoxymethyl, 4-methyl cyclohexyl, p-methoxyphenyl, p-ethylbenzyl, 3-propyl-5-methylphenyl, etc. R may preferably be hydrogen. R''' is preferably hydrogen or methyl. Illustrative of the acids may be:

TABLE

| |
|---|
| $CH_2=CH-COOH$ |
| $CH_2=\underset{\underset{\displaystyle CH_3}{\vert}}{C}-COOH$ |
| $CH_3CH=CH-COOH$ |
| $CH_3CH=\underset{\underset{\displaystyle CH_3}{\vert}}{C}-COOH$ |
| $C_2H_5CH=CH-COOH$ |

TABLE-continued

| |
|---|
| $C_6H_5CH_2{=}CH{-}COOH$ |
| $C_6H_5CH_2CH_2{=}CH{-}COOH$ |
| $C_6H_{11}CH{=}CH{-}COOH$ |
| 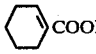 |

Preferred of the above acids are the first two listed: acrylic acid and methacrylic acid.

The amines which may be employed in practice of this invention include $(R'NH)_{1-a}H_aR''NH_2$ R' may be selected from the same group as that from which R is selected. When R' is hydrogen, polymerization conditions (e.g. high temperature for extended times) should be avoided. Preferably R' is long chain (i.e. 12–20 carbon atoms) alkyl, such as stearyl or alkenyl such as oleyl. R'' may be selected from the same group of hydrocarbons as is R but with one less hydrogen. R'' is preferably a lower (i.e. 1–10 carbon atoms) alkylene group preferably $-CH_2CH_2CH_2-$.

When a is 1, the amine may be $HR''NH_2$ typified by:

TABLE

A. The Armeen OL brand of mono oleyl amine $C_{18}H_{35}NH_2$;

B. The Armeen T brand of tallow amine. (Tallow is the radical containing 25% of oleyl $C_{18}H_{35}-$ and 75% of palmitoyl $C_{16}H_{33}-$ and stearyl $C_{18}H_{37}$)—commonly designated as $C_{14-18}NH_2$;

C. The Armeen C brand of monococo amine (Coco is the radical containing myristyl $C_{14}H_{29}-$, lauryl $C_{12}H_{25}-$, palmityl $C_{16}H_{33}-$, and stearyl $C_{18}H_{37}$)—commonly designated as $C_{12-18}NH_2$.

When a is 0, the amine may be $R'NHR''NH_2$ typically an N-mono-alkyl alkylene diamine such as

TABLE

A. The Duomeen O brand of N-mono-oleyl-1,3-propane diamine;

B. The Duomeen S brand of N-mono-stearyl-1,3-propane diamine;

C. The Duomeen T brand of N-mono-tallow-1,3-propane diamine.

D. The Duomeen C brand of N-mono-coco-1,3-propane diamine.

E. The Duomeen L-11 brand of N-mono-beta undecyl-1,3-propane diamine.

F. The Duomeen OL brand (or the Armogard G-505 brand) of N-mono-oleyl-1,3-diaminopropane.

One preferred $R'NH-R''-NH_2$ is that wherein the R'' group is propylene—$CH_2CH_2CH_2-$ and the R' group may be a $C_{12}-C_{18}$ n-alkenyl group. Another preferred composition may be $R'-NH-CH_2CH_2CH_2NH_2$ wherein R' is a $C_{18}$ straight chain alkenyl group. Most preferred is N-mono oleyl-1,3-diamino propane.

It will be apparent to those skilled in the art that the several reactants may bear inert substituents which are typified by alkyl, alkoxy, nitro, etc. It will also be apparent that the preferred compounds to be employed will be those which are soluble in the solvents employed during the reaction and which produce products which are soluble in or compatible with the system in which the product is to be employed.

Typical polar solvents which may be employed include dimethyl formamide, tetrahydrofuran, dimethyl sulfoxide. A particularly preferred system may include dimethyl formamide.

Typical non-polar solvents which may be employed may include toluene, xylene, ethylbenzene, kerosene, gasoline, pale oil etc. The preferred solvent may be commercial pale oils.

Formation of the desired amino-acid product may be preferably effected by placing one mole of the acid in a reaction vessel dissolved in an excess of solvent. Solvent may be present in amount of 1–10, preferably 1–5, say about 3 ml per g of acid. The amine may be added slowly over 0.1–3, say about 1 hour in total amount of about 1 mole per mole of acid. Temperature of operation may be 20° C.–60° C., say 60° C.

Reaction may be as follows:

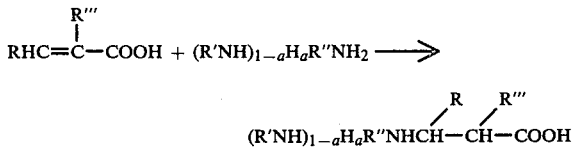

The following reaction typically occurs:

$C_{17}H_{33}NH_2+CH_2{=}CH{-}COOH \rightarrow CH_{17}H_{33}NHCH_2CH_2COOH$

When it is desired to prepare the salt of the amino acid, the same reaction conditions may be employed except that two moles of amine may be employed. Reaction may be as follows:

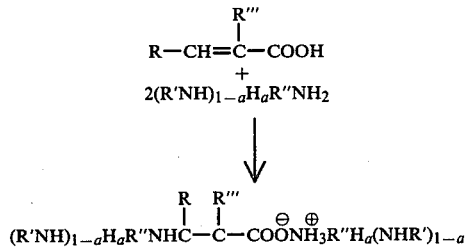

typified by $2C_{17}H_{33}NH_2+CH_2{=}CH{-}COOH \rightarrow C_{17}H_{33}NHCH_2CH_2COO^{\ominus}NH^{\oplus}{}_3C_{17}H_{33}$ Preparation of the amide of the amino acid may be carried out by heating the mixture of amine and acid to a high temperature, typically 110° C.–150° C., say reflux of 120° C. until no more water is recovered. Reaction may be

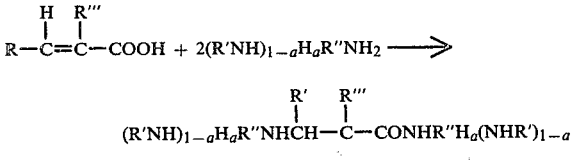

typified by $2C_{17}H_{33}NH_2+CH_2{=}CH{-}COOH \rightarrow C_{17}H_{33}NHCH_2CH_2CONHC_{17}H_{33}$ The reaction product may be a waxy solid or viscous liquid recovered in yield approaching stoichiometric.

The so-prepared anti-wear additives may be added to fuels (including gasohol, etc.). These compositions may be found to be particularly effective when added to gasohol fuels typified by those available commercially.

The so-prepared anti-wear additives may be added to a fuel in amount of 10–30,000 PTB, preferably 30–18,000 PTB, more preferably 300–9000 PTB, say 300 PTB. (PTB stands for pounds of additive per thousand barrels of fuel). Alternatively expressed, the additive may be added to a fuel in minor wear-inhibiting amount of about 0.003–10 w % preferably 0.01–6 w %, more preferably 0.1 w %–3 w%, say 0.1 w %. Larger amounts may be employed but may not be necessary.

It is a feature of this invention that the fuel composition so prepared is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 20%–30%. A reduction of 10% is a significant reduction.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I $$C_{17}H_{33}NH_2 + CH_2{=}CH{-}COOH \rightarrow C_{17}H_{33}NHCH_2CH_2COOH$$

In this Example which illustrates the best mode known to me of practicing this invention, the Armeen OL brand of mono-oleyl amine (139 g, 0.5M) is dissolved in 175 g of 100E Pale Stock HF; and there is added thereto acrylic acid (36 g, 0.5M) at temperature below 60° C. The reaction mixture is then heated to 60° C. for 15 minutes and cooled to give product characterized as follows:

TABLE

| Test | Calc | Found |
|---|---|---|
| TBN | 80 | 80.6 |
| TAN | 80 | 73.8 |
| % N | 1.9 | 2.01 |

TBN is Total Base Number determined by ASTM METHOD D-664.
TAN is Total Acid Number determined by ASTM METHOD D-974.

EXAMPLE II $$C_{17}H_{33}NH_2 + CH_2{=}\underset{\underset{CH_3}{|}}{C}{-}COOH \longrightarrow C_{17}H_{33}NHCH_2\underset{\underset{CH_3}{|}}{CH}{-}COOH$$

In this Example, the Armeen OL brand of mono-oleyl amine (83 g, 0.3M) is dissolved in 109 g of 100E Pale Stock HF; and there is added thereto methacrylic acid (26 g, 0.3M) at temperature below 60° C. The reaction mixture is then heated to 60° C. for 15 minutes and cooled to give product characterized as follows:

TABLE

| Test | Calc | Found |
|---|---|---|
| TBN | 72 | 75.3 |
| TAN | 72 | 83.2 |
| % N | 1.9 | 2.08 |

EXAMPLE III $$(C_{14}H_{29}{-}C_{18}H_{37})NH_2 + CH_2{=}CH{-}COOH \rightarrow (C_{14}H_{29}{-}C_{18}H_{37})NHCH_2{-}CH_2{-}COOH$$

In this Example, the Armeen T brand of mono-tallow amine (tallow is a well known commercially available composition containing primarily straight chain saturated hydrocarbons having 14–18 carbon atoms) (138 g, 0.5M) is dissolved in 174 g of 100 E Pale Stock HF; and there is added thereto acrylic acid (36 g, 0.5M) at temperature below 60° C. The reaction mixture is then heated to 60° C. for 15 minutes and cooled to give product characterized as follows:

TABLE

| Test | Calc | Found |
|---|---|---|
| TBN | 81 | 80.3 |
| TAN | 81 | 74.3 |
| % N | 1.9 | 2.32 |

EXAMPLE IV $$C_{17}H_{33}NH{-}CH_2CH_2CH_2NH_2 + CH_2{=}CH{-}COOH \rightarrow C_{17}H_{33}NH{-}CH_2CH_2CH_2NHCH_2CH_2{-}COOH$$

In this Example, the Duomeen OL brand of N-mono-oleyl-1,3-diaminopropane (181 g, 0.5M) is dissolved in 217 g of 100E Pale Stock HF; and there is added thereto acrylic acid (36 g, 0.5M) at temperature below 60° C. The reaction mixture is then heated to 60° C. for 15 minutes and then cooled to give product characterized as follows:

TABLE

| Test | Calc | Found |
|---|---|---|
| TBN | 133 | 133.4 |
| TAN | 66 | 61.9 |
| % N | 3.3 | 3.30 |

EXAMPLE V $$2C_{17}H_{33}NH_2 + CH_2{=}CH{-}COOH \rightarrow C_{17}H_{33}NHCH_2\text{-}CH_2COO^{\ominus}N^{\oplus}H_3C_{17}H_{33}$$

In this Example, the Armeen OL brand of monooleyl amine (167 g, 0.58M) is dissolved in 188 g Pale Stock HF; and there is added thereto acrylic acid (21 g, 0.29M) at temperature below 60° C. The reaction mixture is then heated to 60° C. for 15 minutes and cooled to give product characterized as follows:

TABLE

| Test | Calc | Found |
|---|---|---|
| TBN | 89 | 88.9 |
| TAN | 45 | 40.1 |
| % N | 2.2 | 2.19 |

EXAMPLE VI $$2C_{17}H_{33}NH_2 + CH_2{=}CH{-}COOH \rightarrow C_{17}H_{33}NHCH_2\text{-}CH_2{-}CONHC_{17}H_{33}$$

In this Example, the Armeen OL brand of monooleyl amine (195 g, 0.70M) is dissolved in 195 g xylene; and there is added thereto acrylic acid (25 g, 0.35M) in 25 g xylene. The reaction mixture is heated at reflux until no more water is recovered. The xylene is then stripped leaving 223 g of product characterized as follows:

TABLE

| Test | Calc | Found |
|---|---|---|
| TBN | 96 | 99.0 |
| TAN | 0 | 12.1 |
| M. Wt. | 587 | 584 |
| % C | 79.8 | 76.6 |
| % H | 12.7 | 12.2 |
| % N | 7.77 | 4.46 |

EXAMPLE VII*

In this control example, a base fuel, gasoline containing 10 v% absolute ethanol, is subjected to the Four Ball Wear Test (1800 RPM, 5 Kg, 5 min at room temperature 70° F.-75° F.).

In each of the following experimental Examples 0.1 w% of product is added to the Base Fuel of Example VII*

TABLE

| Example | Additive of Example | Scar Diameter |
|---|---|---|
| VII* | none | 0.35 |
| VIII | I | 0.27 |
| IX | II | 0.27 |
| X | III | 0.28 |
| XI | IV | 0.30 |
| XII | V | 0.27 |
| XIII | VI | 0.31 |

From the above table, it will be apparent to those skilled-in-the art that it is possible to obtain improvement in the wear characteristics of a base fuel by 130%. It is possible to reduce the corrosion to 77%-88% of the value measured with the base fuel.

Although this invention has been illustrated by reference to specific embodiments, it will be apparent to those skilled in the art that various changes and modifications may be made which clearly fall within the scope of this invention.

We claim:

1. A fuel composition for internal combustion engines comprising
   (a) a major portion of a fuel containing (i) at least one alcohol selected from the group consisting of ethanol and methanol and (ii) gasoline; and
   (b) a minor wear-inhibiting amount of, as a wear-inhibiting additive, a reaction product of an acid containing the group $$R{-}CH{=}\overset{\overset{R'''}{|}}{C}{-}COOH$$

and the amine $(R'NH)_{1-a}H_aR''NH_2$ wherein R,R', and R''' are hydrogen, alkyl, alkaryl, aralkyl, aryl, cycloalkenyl, or cycloalkyl and R'' is alkylene, cycloalkylene, aralkylene, alkarylene, or arylene; and a is 0 or 1.

2. A fuel composition for internal combustion engines as claimed in claim 1 wherein said fuel is gasohol.

3. A fuel composition for internal combustion engines as claimed in claim 1 wherein said fuel contains methanol.

4. A fuel composition for internal combustion engines as claimed in claim 1 wherein said fuel contains ethanol.

5. A fuel composition for internal combustion engines as claimed in claim 1 wherein said fuel contains a commercial ethanol.

6. A fuel composition for internal combustion engines as claimed in claim 1 wherein said fuel contains a commercial ethanol containing acid.

7. A fuel composition for internal combustion engines as claimed in claim 1 wherein said fuel contains a commercial ethanol containing acetic acid.

8. A fuel composition for internal combustion engines as claimed in claim 1 wherein said fuel is gasohol containing 90-95 volumes of gasoline and 5-10 volumes of ethanol.

9. A fuel composition for internal combustion engines as claimed in claim 1 wherein said fuel is substantially anhydrous.

10. A fuel composition for internal combustion engines as claimed in claim 1 wherein said fuel contains less than 0.3 v % water.

11. A fuel composition for internal combustion engines as claimed in claim 1 wherein said acid is an acrylic acid.

12. A fuel composition for internal combustion engines as claimed in claim 1 wherein said acid is acrylic acid.

13. A fuel composition for internal combustion engines as claimed in claim 1 wherein said acid is methacrylic acid.

14. A fuel composition for internal combustion engines as claimed in claim 1 wherein said amine is $HR''NH_2$.

15. A fuel composition for internal combustion engines as claimed in claim 1 wherein said amine is $R'NHR''NH_2$.

16. A fuel composition for interal combustion engines claimed in claim 1 wherein said amine is $C_{17}H_{33}NH_2$.

17. A fuel composition for internal combustion engines as claimed in claim 1 wherein said amine is $C_{14}H_{29}{-}C_{18}H_{33})NH_2$.

18. A fuel composition for internal combustion engine as claimed in claim 1 wherein said amine is $C_{17}H_{33}NH{-}CH_2CH_2CH_2NH_2$.

19. A fuel composition for internal combustion engines as claimed in claim 1 wherein said minor wear-inhibiting additive amount is 0.003–10 wt%.

20. A fuel composition for internal combustion engines as claimed in claim 1 wherein said wear-inhibiting additive is $C_{17}H_{33}NHCH_2CH_2COOH$.

21. A fuel composition for internal combustion engines as claimed in claim 1 wherein said wear-inhibiting additive is $C_{17}H_{33}NHCH_2CH_2COO^{\ominus}N^{\oplus}H_3C_{17}H_{33}$.

22. A fuel composition for internal combustion engines as claimed in claim 1 wherein said wear-inhibiting additive is $C_{17}H_{33}NHCH_2CH_2CONHC_{17}H_{33}$.

23. A fuel composition for internal combustion engines as claimed in claim 1 wherein said wear-inhibiting additive is $(C_{14}H_{29}—C_{18}H_{37})NHCH_2CH_2COOH$.

24. A fuel composition for internal combustion engines as claimed in claim 1 wherein said wear-inhibiting additive is $$C_{17}H_{33}NHCH_2\underset{\underset{CH_3}{|}}{CH}—COOH$$

25. A fuel composition for internal combustion engines as claimed in claim 1 wherein said wear-inhibiting additive is $C_{17}H_{33}NHCH_2CH_2CH_2NHCH_2CH_2COOH$.

* * * * *

UNITED STATES PATENT AND TRADEMARK OFFICE

CERTIFICATE OF CORRECTION

PATENT NO. : 4,459,132

DATED : August 19, 1983

INVENTOR(S) : Benjamin Kaufman - Mark D. Levin

It is certified that error appears in the above—identified patent and that said Letters Patent is hereby corrected as shown below:

Column 8, line 16, after "alkyl", insert --alkenyl--;

Column 8, line 65, correct the formula to read

--$(C_{14}H_{29}-C_{18}H_{37})NH_2$--

Signed and Sealed this

*Fourth* Day of *December 1984*

[SEAL]

*Attest:*

GERALD J. MOSSINGHOFF

*Attesting Officer*

*Commissioner of Patents and Trademarks*